US007192130B2

(12) United States Patent
Shimizu et al.

(10) Patent No.: US 7,192,130 B2
(45) Date of Patent: Mar. 20, 2007

(54) INK JET HEAD AND INK JET RECORDING APPARATUS

(75) Inventors: Kazuo Shimizu, Ibaraki (JP); Osamu Machida, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 220 days.

(21) Appl. No.: 10/752,511

(22) Filed: Jan. 8, 2004

(65) Prior Publication Data

US 2004/0227797 A1 Nov. 18, 2004

(30) Foreign Application Priority Data

Jan. 10, 2003 (JP) ..... P.2003-003908

(51) Int. Cl.
*B41J 2/175* (2006.01)
*B41J 2/04* (2006.01)

(52) U.S. Cl. ..... 347/93; 347/54

(58) Field of Classification Search ..... 347/20, 347/54, 85, 93

See application file for complete search history.

(56) References Cited

U.S. PATENT DOCUMENTS 4,864,329 A * 9/1989 Kneezel et al. ..... 347/93
5,489,930 A * 2/1996 Anderson ..... 347/71
5,610,645 A * 3/1997 Moore et al. ..... 347/93
6,109,738 A * 8/2000 Miyata et al. ..... 347/71
6,234,623 B1 * 5/2001 Drake ..... 347/93
6,260,957 B1 * 7/2001 Corley et al. ..... 347/63

FOREIGN PATENT DOCUMENTS

JP 11-291514 10/1999

* cited by examiner

*Primary Examiner*—Ahn T. N. Vo
(74) *Attorney, Agent, or Firm*—McGinn IP Law Group, PLLC

(57) ABSTRACT

An ink jet head includes: a pressure chamber that stores an ink and has an orifice; a filter plate including a through hole portion and a filter portion, the through hold portion disposed separately from the filter portion with a certain gap; a supply unit that supplies the ink through the filter portion to the pressure chamber; and a jetting unit that jets ink droplets through the orifice from the pressure chamber. The filter portion is formed to have a first aperture ratio. At least one through hole is formed on the through hole potion so that the filter portion has a second aperture ratio. The first aperture ratio is smaller than the second aperture ratio.

12 Claims, 5 Drawing Sheets

INK JET HEAD AND INK JET RECORDING APPARATUS

BACKGROUND OF THE INVENTION

1. Field of the Invention

The present invention relates to an ink jet head, and more particularly to a filter for removing the foreign matter and air bubbles in the ink, an ink jet head having the filter, and an ink jet recording apparatus using the ink jet head.

2. Background Art

Generally, an ink jet head discharges the ink by applying a pressure to the ink introduced through an ink inlet opening by driving a piezoelectric element. In this ink jet head, if the foreign matter exists in the supplied ink, an ink flow passage or nozzle may be clogged, causing a discharge failure. Also, when air bubbles residing in the ink impede the flow of the ink, or the pressure applied by the piezoelectric element is absorbed, a discharge failure is caused. Therefore, a filter for removing the foreign matter or air bubbles in the ink through a plurality of minute holes is usually mounted on the way to the ink supply passage.

This filter conventionally employs a texture woven from the fiber as the filter pores. When the ink passes through the filter pores, the foreign matter and air bubbles are removed. However, since the filter of this structure does not allow the use of too thin fiber, the aperture ratio is reduced if the filter pores are smaller. Consequently, there is a problem that a pressure loss in flowing the ink is increased, degrading the discharge performance. (Here, the aperture ratio of the filter is a ratio of sum total area of the filter pores in proportion to the area of the whole filter portion.)

Also, a method for increasing the aperture ratio was disclosed in which a nickel plate formed with round pores by electro-forming is employed as the filter. (refer to JP-A-11-291514) The aperture ratio of the filter produced by this method is about 30%, and the filter having less influence on the pressure loss in the flow of the ink can be produced.

However, when the nozzle diameter of a head is reduced along with the higher definition of print in recent years, there is a need for reducing the diameter of filter pore. The electro-forming method may not treat this need in some cases, due to a limited resolution of patterning the resist. Also, there was a problem that nickel was corroded when the discharged liquid was a solvent or corrosive liquid.

Thus, a filter portion is formed with the concave portions of predetermined shape by etching the surface and back face, employing a corrosion-resistant material for the discharge liquid, the through holes being provided in the areas where the concave portions overlap. However, the filter member has a pattern for positioning with other parts, in addition to the filter portion. If due to a dispersion in the etching progress rate within the part face, the timing when the portion of through hole is penetrated is varied, there is a distribution in the flow of etchant, amplifying the distribution of etching progress rate. Consequently, the filter portion has a lower precision of through hole, and does not operate as the filter.

SUMMARY OF THE INVENTION

In the light of the above-mentioned problems, it is an object of the invention to provide an ink jet head and a recording apparatus in which small pores for flowing the ink are formed at high precision and an anti-corrosion filter is provided.

To achieve the object, the invention provides an ink jet head including: a pressure chamber that stores an ink and has an orifice; a filter plate including a through hole portion and a filter portion, the through hole portion disposed separately from the filter portion with a certain gap; a supply unit that supplies the ink through the filter portion to the pressure chamber; and a jetting unit that jets ink droplets through the orifice from the pressure chamber; wherein the filter portion is formed to have a first aperture ratio; at least one through hole is formed on the through hole potion so that the filter portion has a second aperture ratio; and the first aperture ratio is smaller than the second aperture ratio. With this configuration, the flow of etchant becomes stable around the filter portion, whereby the open holes having minute diameter can be formed at high precision.

Preferably, a size of the gap is larger than the maximum opening length of the through hole and smaller than three times the maximum opening length of the through hole. With this configuration, the filter portion and the through holes are worked without interference between them.

Preferably, the filter portion has a first concave portion in the shape of circle or rectangle, formed on a front surface thereof. The filter portion has a second concave portion in the shape of circle or rectangle smaller in diameter or in side than the first concave portion, the second concave portion formed on a back surface of the filter portion. A through hole is provided in an area where the first concave portion and the second concave portion overlap. With this configuration, the diameter of open hole in the filter portion is changed between the inflow and outflow sides of the ink, and the resistance of flow passage is reduced while the filter performance is maintained.

Preferably, the filter portion has a first concave portion in the shape of rectangle formed on a front surface thereof. The filter portion has a second concave portion in the shape of rectangle formed on a back surface thereof. The first concave portion and the second concave portion are positioned so that the rectangle of the first concave portion and the rectangle of the second concave portion are partially overlapped. A through hole is provided in an area where the rectangle of the first concave portion and the rectangle of the second concave portion overlap. With this constitution, the open holes of small diameter can be formed simply.

Preferably, the filter portion is made of stainless steel. In this way, the filter is improved in the anti-corrosion.

The invention may provide an ink jet recording apparatus, including: a set of print heads having a plurality of ink jet heads arranged in a direction perpendicular to a running direction of printing paper; and a conveyance mechanism for conveying the printing paper; wherein each of the ink jet heads includes: a filter having a plurality of concave portions of predetermined shape formed on a front surface and a back surface thereof and a through hole formed in an area where the concave portions overlap, a pressure chamber having a orifice, a supplying unit that supplies ink through the filter to the pressure chamber, and a jetting unit that jets ink droplets through orifice from the pressure chamber; and the conveyance mechanism conveys the printing paper to be opposed to the orifice.

BRIEF DESCRIPTION OF THE DRAWINGS

The present invention may be more readily described with reference to the accompanying drawings.

DETAILED DESCRIPTION OF THE PREFERRED EMBODIMENTS

The preferred embodiments of the present invention will be described below.

Figure 1:
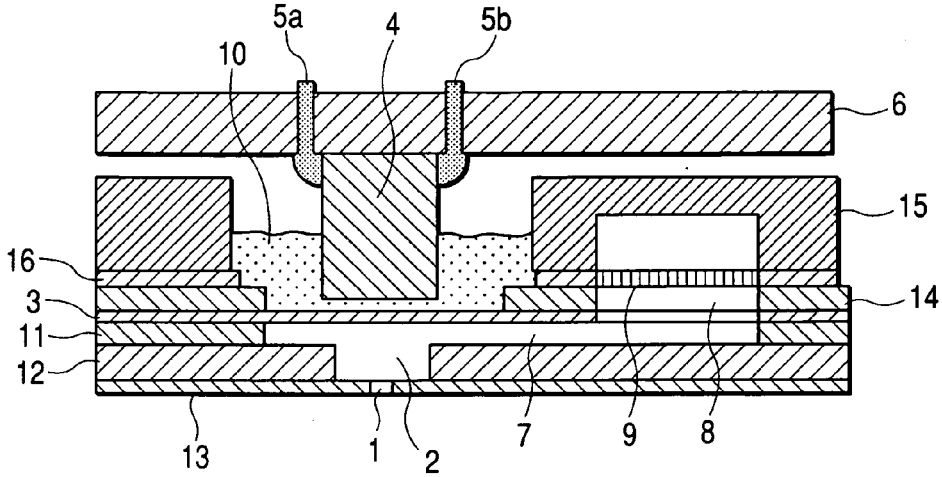
FIG. 1 is a cross-sectional view showing one example of an ink jet print head according to the invention.

FIG. 1 is a cross-sectional view showing one example of a nozzle portion in an ink jet head according to the invention. Reference numeral 1 denotes an orifice, 2 denotes a pressure chamber, 3 denotes a diaphragm, 4 denotes a piezoelectric element, 5*a* and 5*b* denote a signal input terminal, 6 denotes a piezoelectric element fixing board, 7 denotes a restricter for restricting inflow of the ink, the restricter connecting a common ink supply passage 8 and the pressure chamber 2, 8 denotes a common ink supply passage, 9 denotes a filter, 10 denotes an adhesive such as silicone adhesive for bonding the diaphragm 3 and the piezoelectric element 4, 11 denotes a restricter plate forming the restricter 7, 12 denotes a pressure chamber plate forming the pressure chamber 2, 13 denotes an orifice plate forming the orifice 1, 14 denotes a support board for reinforcing the diaphragm 3, 15 denotes a common ink supply passage member for forming the common ink supply passage 8, and 16 denotes a filter plate forming the filter 9.

The diaphragm 3, the restricter plate 11, the pressure chamber plate 12 and the support board 14 are made of stainless material, for example, and the orifice plate 13 is made of nickel or stainless material. Also, the piezoelectric element fixing board 6 is made of an insulating material such as ceramics or polyimide. The ink flows, from upstream to downstream, through the filter 9 on the way to the common ink supply passage 8, and further flows in the order of the restricter 7, the pressure chamber 2 and the orifice 1. The piezoelectric element 4 is expanded or contracted when a potential difference is applied between the signal input terminals 5*a* and 5*b*, and restored to the form before expansion or contraction when there is no potential difference between the signal input terminals 5*a* and 5*b*. Owing to a deformation of this piezoelectric element 4, a pressure is applied to the ink within the pressure chamber 2, so that the ink is discharged out of the orifice.

Figure 2:
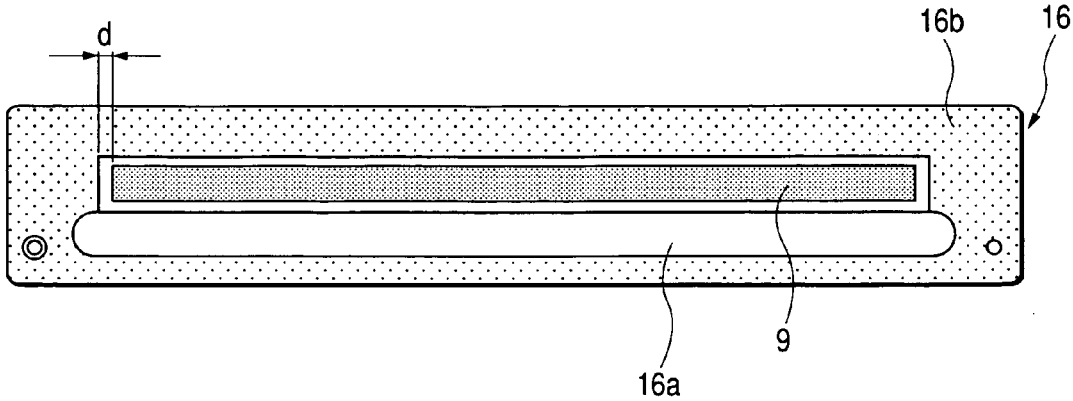
FIG. 2 is a plan view of an ink jet print head filter plate according to the invention.

FIG. 2 is a plan view of the filter plate 16. The filter plate 16 has a portion forming the filter 9, a bored portion 16*a*, and a portion 16*b* formed with a through hole having a larger aperture ratio than the filter 9. The filter portion 9 is formed over the entire face of the common ink supply passage 8. Also, the bored portion 16*a* is a space into which the piezoelectric element 4 is inserted. The portion 16*b* formed with the through hole and the portion 16 forming the filter 9 are provided with a gap d. The gap d is greater than the maximum diameter of the through hole formed in the portion 16*b* and smaller than three times the maximum diameter of the through hole in the portion 16*b*.

Figure 3:
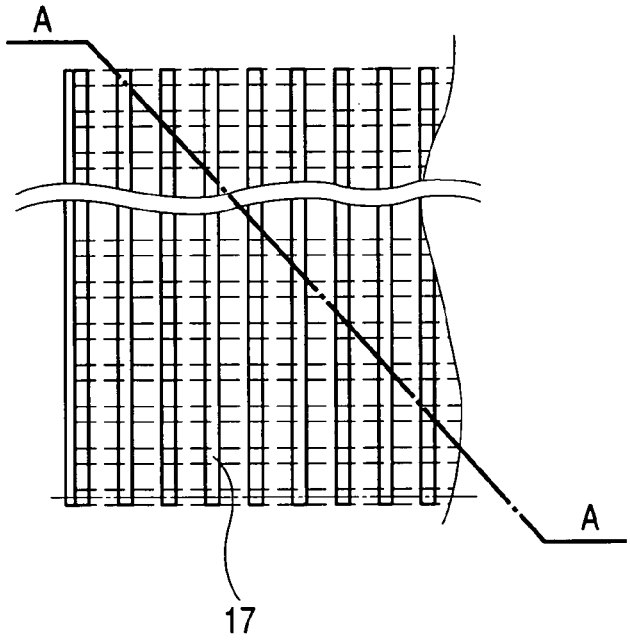
FIG. 3 is an enlarged plan view of an ink jet print head filter portion according to the invention.
Figure 4:
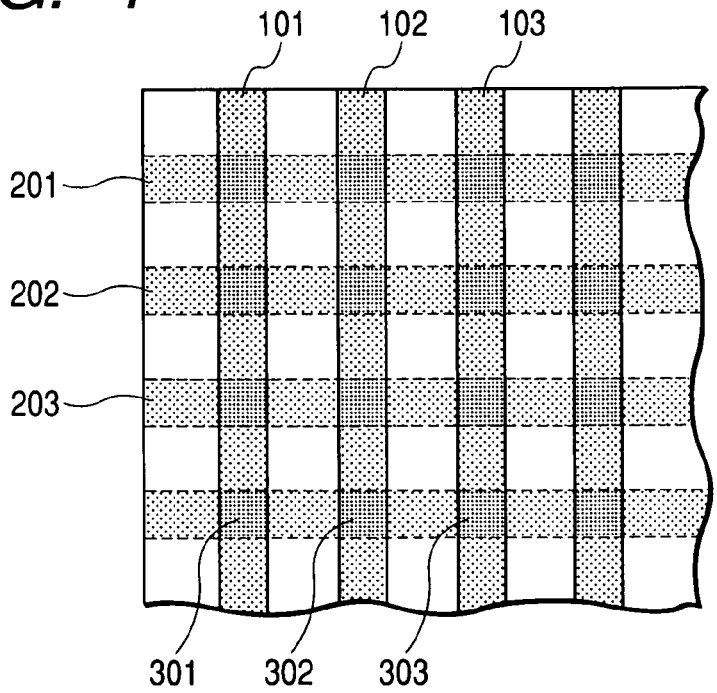
FIG. 4 is an enlarged plan view of FIG. 3.

FIG. 3 is a constitutional view of the filter portion 9. A number of grooves are formed at an equal interval on the surface of the filter portion 9, and a number of grooves are formed at an equal interval in its orthogonal direction on the back face. FIG. 4 shows an enlarged view of the filter portion 9, in which 101, 102 and 103 denote the grooves on the surface, and 201, 202 and 203 denote the grooves formed on the back face. And the depth of each groove is equal to, or slightly larger than, half the thickness of the filter plate 16. Consequently, a square through hole 17 is formed on each of the portions 301, 302 and 303 where the grooves 101, 102 and 103 on the surface and the grooves 201, 202 and 203 on the back face intersect.

Figure 5:
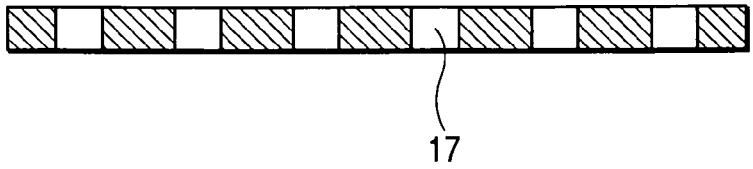
FIG. 5 is a cross-sectional view of the ink jet print head filter portion according to the invention.

FIG. 5 is a cross-sectional view of FIG. 3 taken along the line A—A. The through holes 17 are formed at an equal interval, whereby the foreign matter in the ink is removed when the ink is passed through the through holes 17.

Referring to FIGS. 6A–6D, a manufacturing process of the filter plate used for the ink jet print head according to the invention will be described below.

Figure 6A:
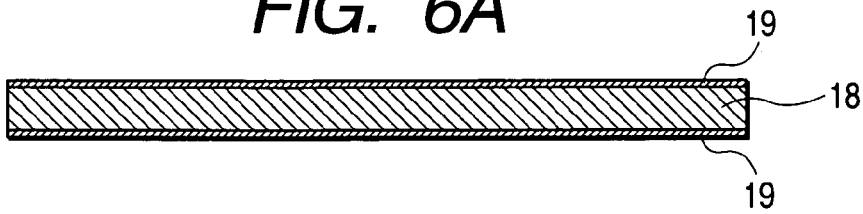
FIGS. 6A–6D are explanatory views showing a manufacturing process of the ink jet print head filter plate according to the invention.
Figure 6B:
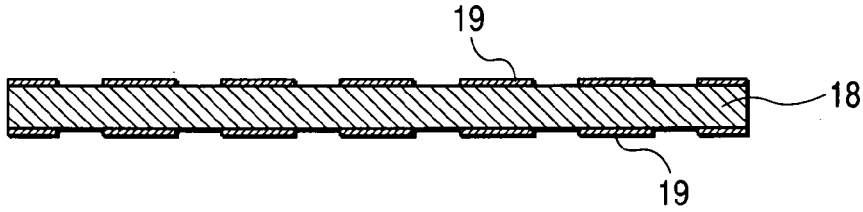

First of all, a dry film resist 19 is pasted by a laminator on both sides of a rolled thin plate 18 of stainless plate (SUS) having a thickness of 25 μm, as shown in FIG. 6A. Then, the dry film resist 19 on the surface and back face of the thin plate 18 is patterned in groove width of 30 μm through a photolithography process, as shown in FIG. 6B. In this case, the resist on the surface is pattern at equal interval in the longitudinal direction, and the resist on the back face is pattern at equal interval in the transverse direction, so that both the resist layers become orthogonal.

Figure 6C:
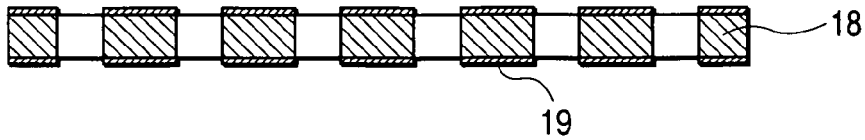

The thin plate 18 made of stainless steel (SUS) in the groove portion is etched into the depth 13 μm from both sides in a ferric chloride solution, as shown in FIG. 6C. Etchant should be sprayed onto both sides at the same time to decrease a dispersion in the etching on both sides.

Roughly at the final stage of etching, the portion 16*a* forming the filter 9 is formed with a through hole at a position where the grooves on both sides intersect. At this time, etchant is more likely to stay near the outer periphery of the portion 16*a* forming the filter 9 than near the center of the portion 16*a*, deviating the etching rate. The etchant is prevented from staying owing to a gap provided between the portion 16*a* forming the filter 9 and the portion 16*b* formed with through hole, whereby the etching rate is kept uniform within the portion 16*a* forming the filter 9. If the gap d between the filter portion and the through hole around the filter portion is smaller than the maximum length of opening in the through hole around the filter portion, the through hole around the filter portion may possibly interfere and communicate with the filter portion. Also, if the gap d is larger than three times the maximum length of opening in the through hole around the filter portion, the etchant is less effectively prevented from staying, causing a distribution in the etching rate.

Figure 6D:
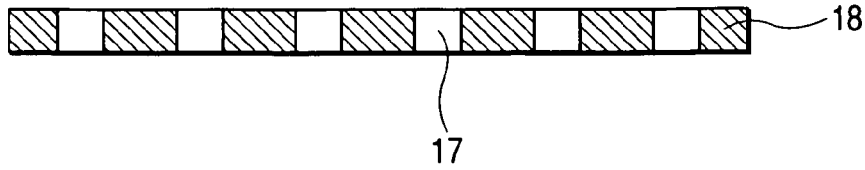

Lastly, the dry film resist 19 on both sides is removed by a release agent, whereby the filter portion formed with the through holes 17 at equal interval is completed, as shown in FIG. 6D.

In this example, the width of groove is 30 μm, but not limited to this value. That is, if the width of groove is smaller than the diameter of orifice 1, the filter portion has a smaller length of one side than the diameter of orifice, whereby the orifice 1 is not clogged. Usually, it is desirable that the diameter of orifice is 80 μm or less, and the width of groove is in a range from 20 to 60 μm.

The number of through holes 17 can be adjusted by changing the pitch of grooves, whereby the aperture ratio is arbitrarily set up. For example, in a case where the width of groove is 30 μm and the pitch is 55 μm, the aperture ratio is 13.2%. The aperture ratio is related with the resistance in the flow of ink, and has some influence on the frequency response characteristics in discharging the ink. Usually, it does not matter that the aperture ratio is 10% or more, whereby the pitch of groove may be chosen in this range. Also, various methods are conceived for joining the filter plate with the support board 14 and the common ink supply passage member 15. For example, when an adhesive having the ink-proofness is applied or transferred thin, the through hole portion 16 is useful as an escape hole for excess adhesive. Since extrusion of the adhesive into the ink flow passage is prevented, there is the effect of reducing a dispersion in the ink discharge characteristic.

Figure 7:
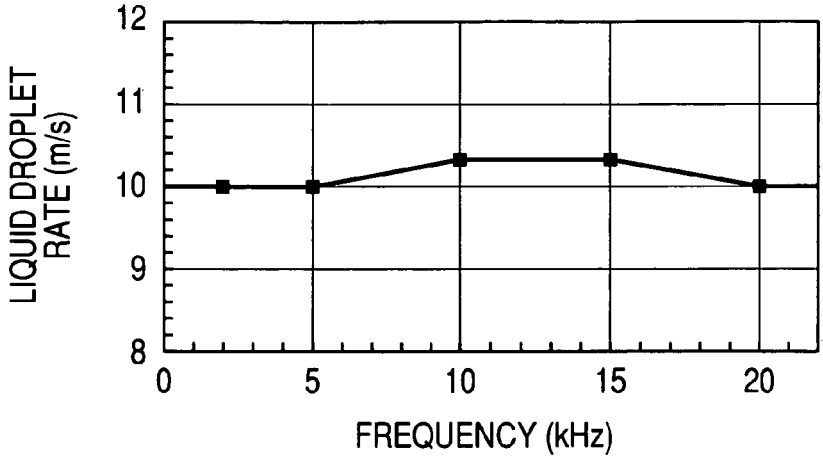
FIG. 7 is a characteristic curve showing the relationship between the drive frequency and the liquid droplet speed in the ink jet print head according to the invention.

FIG. 7 is a characteristic curve showing the relationship between the drive frequency and the discharge rate of liquid droplets in the print head having built the filter plate of this example. It will be apparent that there is less variation in the discharge rate of ink droplets at a drive frequency of 20 kHz, which indicates the excellent characteristic.

Figure 8:
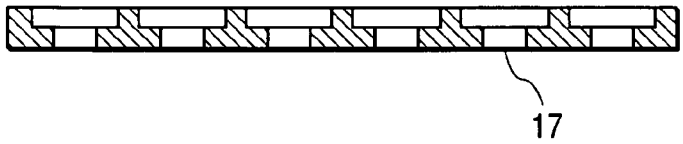
FIG. 8 is a cross-sectional view showing a second example of an ink jet print head filter portion according to the invention.
Figure 9:
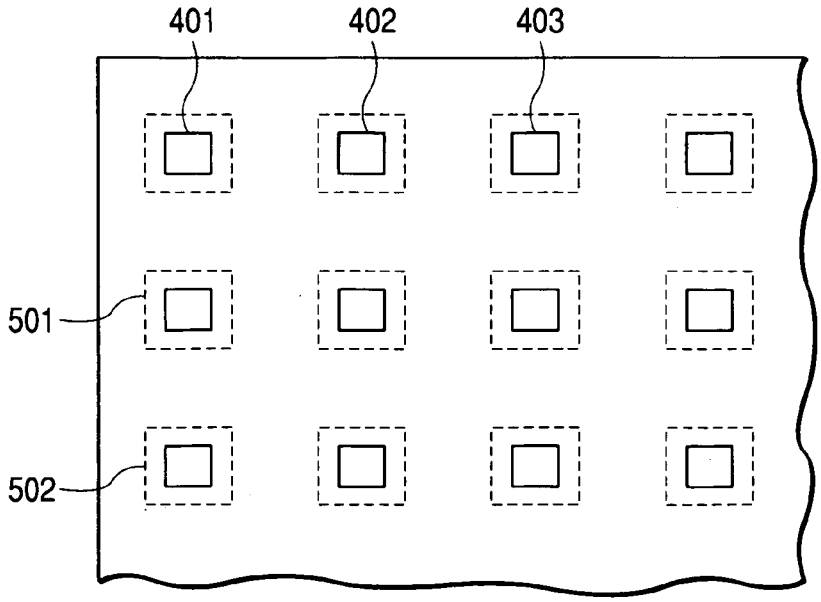
FIG. 9 is a plan view showing the second example of the ink jet print head filter portion according to the invention.

FIG. 8 is a cross-sectional view showing a second example of an ink jet print head filter portion according to the invention and FIG. 9 is its upper view. In this example, a number of square concave portions are formed by etching on the surface and back face of the filter plate, as shown in FIG. 9. The depth of concave portions 401, 402 and 402 on the surface is etched about half the thickness of the filter plate. On the other hand, the square size of concave portions 501 and 502 on the back face is etched larger than the square size of concave portions 401, 402 and 403 on the surface, its depth being set to about half the thickness of the filter plate. Consequently, the through hole 17 in the filter portion 9 is formed such that the width of groove on the ink inflow side is wider than the ink outflow side, as shown in FIG. 8.

The resistance of the ink in passing through the through holes 17 in the filter portion 8 is affected by not only the diameter of hole but also the length of through holes 17. Since the function of the filter to impede passage of the foreign matter is not affected by the length of through holes, it is desirable to make the thickness of the filter plate as small as possible to reduce the resistance, but there is a limited thickness due to easy handling in working and assembling the head. That is, if the thickness is too small, the working and assembling operation becomes difficult. Therefore, the resistance of ink flow is reduced while the diameter of through holes is kept at a predetermined size, making the handling easy in this example.

In the above example, the square holes 17 are formed in the filter portion. The shape of holes is not limited to square, but may be circular in section. Also, the depth of concave portions formed by etching on the surface and back face is about half the thickness of filter plate, but may be varied in various ways.

Conventionally, the thickness of the filter plate was set to the thickness of about 30 μm in consideration of the resistance of flow passage in the opening portion and the easy handling. However, if the opening portion is shaped as shown in FIG. 8, the resistance of flow passage is reduced, whereby the thickness of the filter plate may be set as large as about 50 μm. Also, the thickness of the smaller diameter portion in the opening portion 17 can be about 10 μm at minimum, and is desirably 25 μm or less due to the resistance of flow passage. Accordingly, it is desirable that the thickness of the larger diameter portion is from 25 to 40 μm when the total thickness is 50 μm, or from 15 to 20 μm when the total thickness is 30 μm. That is, the desired range in this example is such that the filter plate from 25 to 50 μm, the thickness of the opening portion with smaller diameter is from 10 to 25 μm, and the thickness of the opening portion with larger diameter is 15 μm or more.

Figure 10:
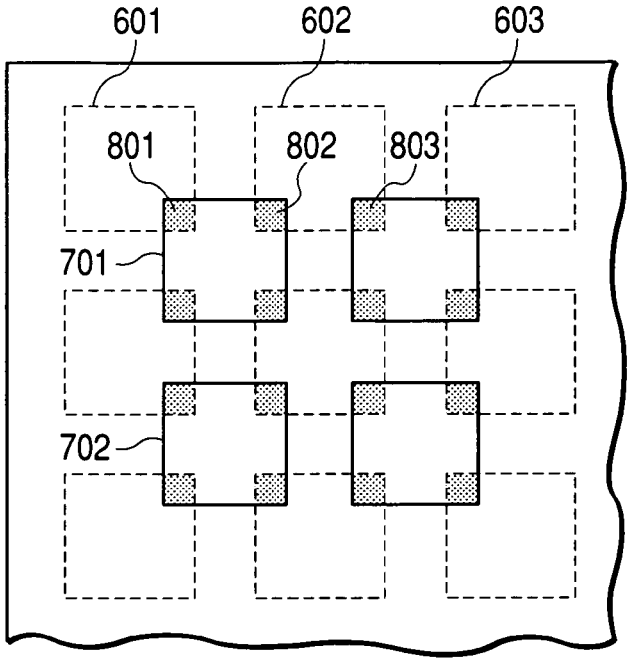
FIG. 10 is a plan view showing a third example of an ink jet print head filter portion according to the invention.

FIG. 10 is an upper view showing a third example of an ink jet head filter portion according to the invention. In this example, the surface of the filter portion is etched in the shape of rectangles 701 and 702 to form the concave portions, and the back face is etched in the shape of rectangles 602 and 603 to form the concave portions at shifted positions. In this manner, the overlapping area 801, 802 and 803 of the rectangles 701 and 702 and the rectangles 601, 602 and 603 become the through holes.

With the progress of the lithography technique, it is relatively easy to form the openings of smaller diameter, but it may be difficult to bore the hole of about a few 10 μm depending on the material or thickness of plate. However, if the opening portion is formed in the manner as in the third example, there is the effect that the resolution of lithography is not required to be so high, and the hole portion is formed minutely.

One example of an ink jet recording apparatus using the ink jet head according to the invention will be described below.

Figure 11:
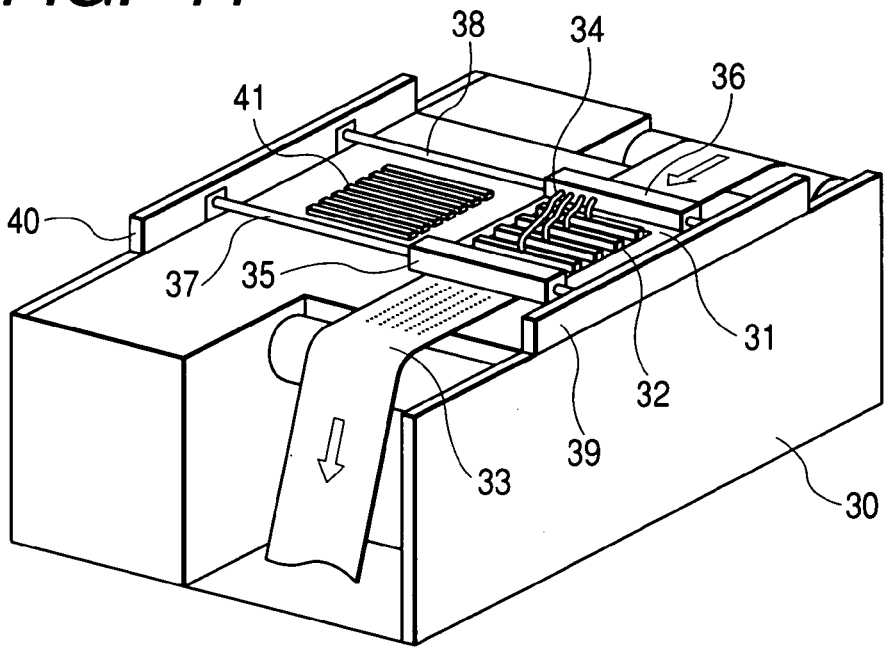
FIG. 11 is an appearance view showing one example of a recording apparatus using an ink jet head according to the invention.

In FIG. 11, a head base 31 is disposed on the top of a housing 30, and a set of four print heads 32 are provided on the head base 31. A roll paper conveying device and a control device, though not shown, are accommodated inside the housing 30. The set of four print heads 32 is supplied with color inks of cyan, magenta, yellow and black for color printing from four ink supply pipes 34. Each set of heads 32 has twenty heads for example arranged in a direction perpendicular to the longitudinal direction of the printing paper, each head being provided with for example 128 nozzles, as shown in FIG. 1. The printing paper 33 is conveyed to be opposite the orifices (FIG. 1) of the nozzles. In FIG. 11, the roll paper is conveyed in the arrow direction, and a roll paper supply device is disposed on the upstream side, but not shown in the figure.

The rods 37 and 38 are provided between the upper frames 39 and 40 of the housing 30, and borne so that the supporters 35 and 36 may be able to slide along the rods 37 and 38. Since the head base 31 is attached to the supporters 35 and 36, the set of print heads 32 is moved in a direction perpendicular to the longitudinal direction of the printing paper 33 up to a position of a head cleaning mechanism 40.

The ink jet head of the invention may be employed for a universal and small ink jet recording apparatus, in addition to the recording apparatus as described above.

As described above, in the ink jet print head according to the invention, the aperture ratio of through hole is "filter portion<through hole portion with a certain gap from the filter portion". Thereby, etchant staying in the filter portion is reduced to prevent etching failure from being caused by a distributed etching rate.

Also, the interval between the filter portion and the through hole around filter portion is "maximum opening length of the through hole around filter portion<interval between the filter portion and the through hole around filter portion <three times the maximum opening length of the through hole around filter portion". Thereby, there is the effect of reducing the etching failure, and the through hole around filter portion does not interfere and communicate with the filter portion.

Moreover, the concave portions like grooves or rectangles are formed on the surface and back face of the filter plate, and the through holes are provided in the areas where the concave portions overlap, whereby the filter having the openings of small diameter is produced, and the high precision ink jet printer is realized employing this filter plate.

Additionally, the filter plate is made of stainless steel (SUS), various kinds of ink and liquid are discharged, whereby the universal ink jet head is realized.

What is claimed is:

1. An ink jet head comprising:

a pressure chamber that stores an ink and has an orifice:

a filter plate including a through hole portion and a filter portion, the through hole portion disposed separately from the filter portion by a certain gap;

a supply unit that supplies the ink through the filter portion to the pressure chamber; and a jetting unit that jets ink droplets through the orifice from the pressure chamber;

wherein the filter portion has a first aperture ratio;

at least one first through hole is formed on the through hole portion so that the through hole portion has a second aperture ratio; and the first aperture ratio is smaller than the second aperture ratio;

wherein the filter portion includes a first groove on a front surface of the filter portion;

the filter portion includes a second groove on a back surface of the filter portion, the second groove extends in a direction perpendicular to the first groove; and a second through hole is in an area of the filter portion where the first groove and the second groove overlap.

2. The ink jet head according to claim 1, wherein the first groove and the second groove are formed by etching.

3. The ink jet head according to claim 1, wherein a width of at least one of the first groove and the second groove are 20 to 60 μm;

a diameter of the orifice is 80 μm or less; and the first aperture ratio is 10% or more.

4. An ink jet head comprising:

a pressure chamber that stores an ink and has an orifice;

a filter plate including a through hole portion and a filter portion, the through hole portion disposed separately from the filter portion by a certain gap;

a supply unit that supplies the ink through the filter portion to the pressure chamber; and a jetting unit that jets ink droplets through the orifice from the pressure chamber;

wherein the filter portion has a first aperture ratio;

at least one first through hole is formed on the through hole portion so that the through hole portion has a second aperture ratio; and the first aperture ratio is smaller than the second aperture ratio;

wherein a front surface of the filter portion includes a first concave portion in a shape of a circle or a rectangle;

a back surface of the filter portion includes a second concave portion in the shape of a circle or a rectangle that is smaller in a diameter or in a side than the first concave portion, the second concave portion; and a second through hole is in an area where the first concave portion and the second concave portion overlap.

5. The ink jet head according to claim 4, wherein the first concave portion and the second concave portion are formed by etching.

6. The ink jet head according to claim 4, wherein the second through hole in the filter portion includes a plurality of second through holes for passing the ink;

each of the plurality of second through holes includes a first portion having a larger diameter and a second portion having a smaller diameter than the first portion;

the first portion is located on an inflow side of the filter portion; and the second portion is located on an outflow side of the filter portion.

7. The ink jet head according to claim 6, wherein a thickness of the filter portion is 10 to 50 μm;

a thickness of the first portion is 15 μm or more; and a thickness of the second portion is 10 to 25 μm.

8. An ink jet head comprising:

a pressure chamber that stores an ink and has an orifice;

a filter plate including a through hole portion and a filter portion, the through hole portion disposed separately from the filter portion by a certain gap;

a supply unit that supplies the ink through the filter portion to the pressure chamber; and a jetting unit that jets ink droplets through the orifice from the pressure chamber;

wherein the filter portion has a first aperture ratio;

at least one first through hole is formed on the through hole portion so that the through hole portion has a second aperture ratio; and the first aperture ratio is smaller than the second aperture ratio;

wherein a front surface of the filter portion includes a first concave portion in a shape of a rectangle;

a back surface of the filter portion includes a second concave portion in the shape of a rectangle; and the first concave portion and the second concave portion partially overlap to define a second through hole.

9. The ink jet head according to claim 8, wherein the first concave portion and the second concave portion are formed by etching.

10. The ink jet head according to claim 8, wherein a width of at least one of the first concave portion and the second concave portion is 50 to 150 μm;

a diameter of the orifice is 80 μm or less; and the first aperture ratio is 10% or more.

11. A filter plate for an ink jet head comprising:

a filter comprising a first through hole and having a first aperture ratio;

a through hole portion comprising a second through hole and having a second aperture ratio; and a gap portion separating said filter from said through hole portion, wherein said first aperture ratio is smaller than said second aperture ratio;

wherein said filter comprises a first groove on a front surface and a second groove on a back surface which overlap to form said first through hole.

12. A filter plate for an ink jet head comprising:

a filter comprising a first through hole and having a first aperture ratio;

a through hole portion comprising a second through hole and having a second aperture ratio; and a gap portion separating said filter from said through hole portion, wherein said first aperture ratio is smaller than said second aperture ratio;

wherein said filter comprises a first concave portion on a front surface of said filter and a second concave portion on a back surface of said filter which overlaps said first concave portion to define said first through hole, and wherein one of said first concave portion and said second concave portion extends only partially into said filter.

* * * * *